US007337854B2

(12) United States Patent
Horn et al.

(10) Patent No.: US 7,337,854 B2
(45) Date of Patent: Mar. 4, 2008

(54) GAS-PRESSURIZED LUBRICATOR AND METHOD

(75) Inventors: Ben Horn, Lafayette, LA (US); William Hearn, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 314 days.

(21) Appl. No.: 10/996,867

(22) Filed: Nov. 24, 2004

(65) Prior Publication Data

US 2006/0108126 A1 May 25, 2006

(51) Int. Cl.
*E21B 43/00* (2006.01)

(52) U.S. Cl. ..... 166/383; 166/68; 166/105

(58) Field of Classification Search ..... 166/370, 166/372, 383, 68, 105, 153
See application file for complete search history.

(56) References Cited

U.S. PATENT DOCUMENTS 1,784,110 A * 12/1930 Ricker ..... 417/56
1,790,450 A * 1/1931 Torrance ..... 166/372
1,836,876 A * 12/1931 Ricker ..... 417/56
3,351,021 A * 11/1967 Moore, Jr. ..... 417/57

FOREIGN PATENT DOCUMENTS

GB 1171550 11/1969

OTHER PUBLICATIONS

GB Search Report, Application No. GB0523761.5, dated Mar. 24, 2006.
Bolling Abercrombie, Plunger Lift, The Technology of Artificial Lift Methods, Chapter 7, pp. 483-508, vol. 2b.
Plunger Lift, Production Control Services Inc., www.pcsplungerlift.com, © 1998, Fort Lupton, Colorado.
E. Beauregard, et al., Introduction to Plunger Lift: Applications, Advantages and Limitations, Apr. 23-24, 1981, Lubbock , Texas.

* cited by examiner

*Primary Examiner*—David Bagnell
*Assistant Examiner*—Robert Fuller
(74) *Attorney, Agent, or Firm*—Patterson & Sheridan, LLP

(57) ABSTRACT

Embodiments of the present invention provide methods and apparatus for reducing kinetic energy of a plunger within a plunger lift system. In one aspect, a lubricator is provided at a surface of a wellbore, the lubricator having a sealed, pressurized chamber therein to cushion the plunger upon impact. In another aspect, a method is provided for reducing the kinetic energy of the plunger by providing a compressed gas chamber within a lubricator, moving a kinetic energy-reducing surface which is partially bounding the chamber, and compressing the gas within the chamber to reduce kinetic energy of the plunger and cushion the impact force of the plunger.

21 Claims, 4 Drawing Sheets

GAS-PRESSURIZED LUBRICATOR AND METHOD

BACKGROUND OF THE INVENTION

1. Field of the Invention

Generally, embodiments of the present invention relate to a plunger lift system for artificially lifting fluid. More specifically, embodiments of the present invention relate to a lubricator for a plunger lift system used to lift fluid from a well.

2. Description of the Related Art

To obtain hydrocarbon fluid from an earth formation, a wellbore is drilled into the earth to intersect an area of interest or hydrocarbon-bearing reservoir within a formation. The wellbore may then be "completed" by inserting casing within the wellbore and setting the casing therein using cement. In the alternative, the wellbore may remain uncased (an "open hole wellbore"), or may become only partially cased. Regardless of the form of the wellbore, production tubing is typically run into the wellbore (within the casing when the well is at least partially cased) primarily to convey production fluid (e.g., hydrocarbon fluid, which may also include water) from the reservoir within the wellbore to the surface of the wellbore.

Often, pressure within the wellbore is insufficient to cause the production fluid to naturally rise through the production tubing to the surface of the wellbore. Thus, to carry the production fluid from the reservoir within the wellbore to the surface of the wellbore, artificial lift means is sometimes necessary. Some wells are equipped with a plunger lift system to artificially lift production fluid to the surface of the wellbore.

A plunger lift system generally includes a piston, often termed a "plunger," which cyclically travels the length of the production tubing. The plunger essentially acts as a free piston to provide a mechanical interface between lifted gas from the formation disposed below the plunger and the produced fluid disposed above the plunger, thus increasing the lifting efficiency of the well.

FIG. 1 illustrates a typical plunger lift system within a wellbore 40 formed in an earth formation 85 to intersect a reservoir 80. The formation 85 includes one or more perforations 90 therein for allowing flow of production fluid from the reservoir 80 into the wellbore 40. The typical plunger lift system installation includes a tubular 45, which is usually production tubing, disposed within the wellbore 40.

Disposed proximate a lower end and within a longitudinal bore running through the production tubing 45 is a bottomhole assembly including upper and lower tubing stops 65, 75 having a standing valve 70 therebetween. A lower bumper spring 60 is located above the upper tubing stop 65, and a plunger 55 for lifting well fluid is disposed above the lower bumper spring 60. The lower bumper spring 60 and the tubing stop 65 provide a shock absorber at the lower end of the production tubing 45 to cushion the plunger 55 at the end of its down-stroke.

FIG. 1 shows the standing valve 70 as a separate component from the lower tubing stop 65 and the lower bumper spring 60. In some configurations of bottomhole assemblies, the standing valve 70, lower tubing stop 65, and lower bumper spring 60 all constitute one assembly. In other configurations, two or more of the standing valve 70, lower tubing stop 65, and lower bumper spring 60 may be combined with one another to constitute a portion of the bottomhole assembly. In either case, the lower bumper spring 60 may have a ball and seat integral therewith.

A fluid load 50, which is generally a liquid load of production fluid and/or water, is shown in FIG. 1 being lifted upward toward a surface 10 of the wellbore 40 by the plunger 55. Once the fluid is lifted by the plunger 55, it flows upward through the production tubing 45 until it reaches surface equipment. The surface equipment includes a lubricator 100 for absorbing the shock of force exerted by the upwardly-moving plunger 55 at the end of the plunger's up-stroke. In its cycle, the plunger 55 runs within the bore of the production tubing 45 for the full length of the production tubing 45 between the lower bumper spring 60 and the lubricator 100.

The lubricator 100 is installed on top of a master valve 35 disposed at the surface 10. A first fluid flow outlet 110 and a second fluid flow outlet 120 provide exit paths for the liquid load 50 which may be selectively opened and closed by a plug valve 5 and a valve 15, respectively. Both fluid flow outlets 110, 120 merge into a single flow line which a motor valve 30 is used to open and close. A pressure controller 20 operates the motor valve 30 to form a product 25.

FIG. 2 shows a typical lubricator 100 provided in the plunger lift system having an upper end 101 and a lower end 102. The lower end 102 is connected to the master valve 35 (see FIG. 1).

The lubricator 100 includes a tubular body having a first tubular section 125, usually termed a "spring housing," connected to a second tubular section 145. O-rings 165 are provided at the connection point between the tubular sections 125, 145 to prevent fluid communication between a bore 115 of the lubricator 100 and the atmosphere (see FIG. 1). A cap 130 is connected to an upper end of the spring housing 125. The top of the cap 130, and therefore the upper end 101 of the lubricator 100, is usually flat-shaped, as shown.

The first and second flow outlets 110, 120 and a catcher assembly 140 extend from the tubular body. The catcher assembly 140 retains the plunger 55 to facilitate inspection of the plunger 55. Also extending from the tubular body are handles 135 to permit lifting of the lubricator 100.

At an upper portion of the tubular body, the lubricator 100 includes an upper bumper spring 103 within the bore 115 to attempt to absorb the shock or kinetic energy of the plunger 55 at the end of its up-stroke. A striker assembly 105 (also termed "bumper plate" or "striking pad"), which is disposed within the bore 115 directly below the upper bumper spring 103, provides the solid contact point for the plunger 55. The striker assembly 105 includes an opening 104 which allows fluid communication between the portions of the bore 115 above and below the striker assembly 105.

In operation, the plunger 55 cycles between the lubricator 100 (specifically the striker assembly 105 and upper bumper spring 103) and the bottomhole assembly (specifically the lower bumper spring 60 and the upper tubing stop 65). The bumper springs 103, 60 attempt to absorb the shock or kinetic energy of the plunger 55 at the ends of the up-stroke and down-stroke, respectively, of the plunger lifting cycle.

Using the bumper spring within the lubricator to absorb the shock of the plunger on its up-stroke is problematic because of additional safety hazards which occur with use of the lubricator as well as because of decreased profitability of the well with use of the lubricator. The force of impact of the plunger against the spring often causes the bumper spring to fail, break, or become otherwise damaged. Damage to the spring may require replacement of the spring, decreasing the profits of the well because of down-time during spring replacement. Additionally, damage to the spring may decrease the shock absorption ability of the spring, eventually causing the plunger to blow out the cap and exit the lubricator into the atmosphere. Blowing off the cap from the lubricator creates a safety hazard and usually causes damage to the lubricator, also decreasing the profitability of the well due to down-time to replace or repair the lubricator. Finally, damage to the spring may cause damage to the plunger upon its impact with the striker assembly due to ineffective or non-existent cushioning of the plunger because the damaged spring is dysfunctional or non-functional, ultimately increasing the cost of the well not only because of down-time which occurs to replace or repair the plunger, but also because of the additional cost of replacement parts, specifically the plunger.

Moreover, use of the lubricator having the bumper spring is problematic because damage or failure of the bumper spring, plunger, or other internal components is not detectable using this spring-based lubricator without stopping the plunger lift operation (down-time) and removing the internal components from the lubricator for inspection. Blowout of the plunger from the lubricator upon damage or failure of the internal components is not preventable because of the inability to determine the condition of the internal components during operation of the lubricator (as viewing the internal components is prevented by the presence of the tubular body).

Therefore, there is a need for a lubricator having an improved ability to cushion the plunger at or near the end of its up-stroke. There is a further need for a lubricator which is capable of absorbing the kinetic energy of the plunger at the end of the up-stroke without damaging portions of the lubricator. Furthermore, there is a need for a lubricator which allows monitoring of the plunger energy-absorbing ability of the lubricator in real time during operation of the plunger lift system.

SUMMARY OF THE INVENTION

In one aspect, embodiments of the present invention generally provide a lubricator for reducing a kinetic energy of a plunger at a surface of a wellbore in a plunger lift system, comprising a generally tubular body having a bore therethrough, the bore closed at an end portion thereof; a striker assembly within the bore having a sealed relationship with the tubular body and movable with respect to the tubular body; and a pressurized, sealed chamber formed within the bore between the closed portion and the striker assembly to reduce the kinetic energy of the plunger at the surface. In another aspect, embodiments of the present invention provide a lubricator for reducing shock of a plunger within a plunger lift system upon impact with a kinetic energy-decreasing surface within the lubricator, comprising a substantially tubular body having a pressurized, sealed chamber at least partially bounded by the surface, wherein the surface is movable to alter the pressure within the chamber while maintaining the seal of the chamber.

In yet another aspect, embodiments of the present invention provide a method of decreasing a kinetic energy of a plunger moving through a lubricator, comprising providing a lubricator having a sealed, pressurized chamber within a portion of its bore, the chamber partially enclosed by a striker assembly; moving the plunger through the bore of the lubricator; contacting the striker assembly with pressure induced by the plunger; and decreasing the kinetic energy of the plunger by moving the striker assembly through the sealed chamber.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention generally provide a lubricator capable of sufficiently cushioning a plunger of a plunger lift system when the plunger approaches and/or reaches the end of its up-stroke within the plunger lift system. Using a compressed gas chamber therein, the lubricator stops the upward force of movement of the plunger at the end of the up-stroke of the plunger without damaging the plunger, lubricator, or other internal components, and without blowing out the plunger from the lubricator. Therefore, the lubricators characteristic of embodiments of the present invention provide a safer plunger lift system which is less prone to damage. Increasing the safety of the lubricator and decreasing the damage to components of the lubricator and the plunger lift system advantageously increase the profitability of the well. The increased profitability of the well ensures because costs incurred as a result of well down-time while replacing damaged components as well as costs incurred as a result of safety problems related to the lubricator are decreased or eliminated.

Figure 1:
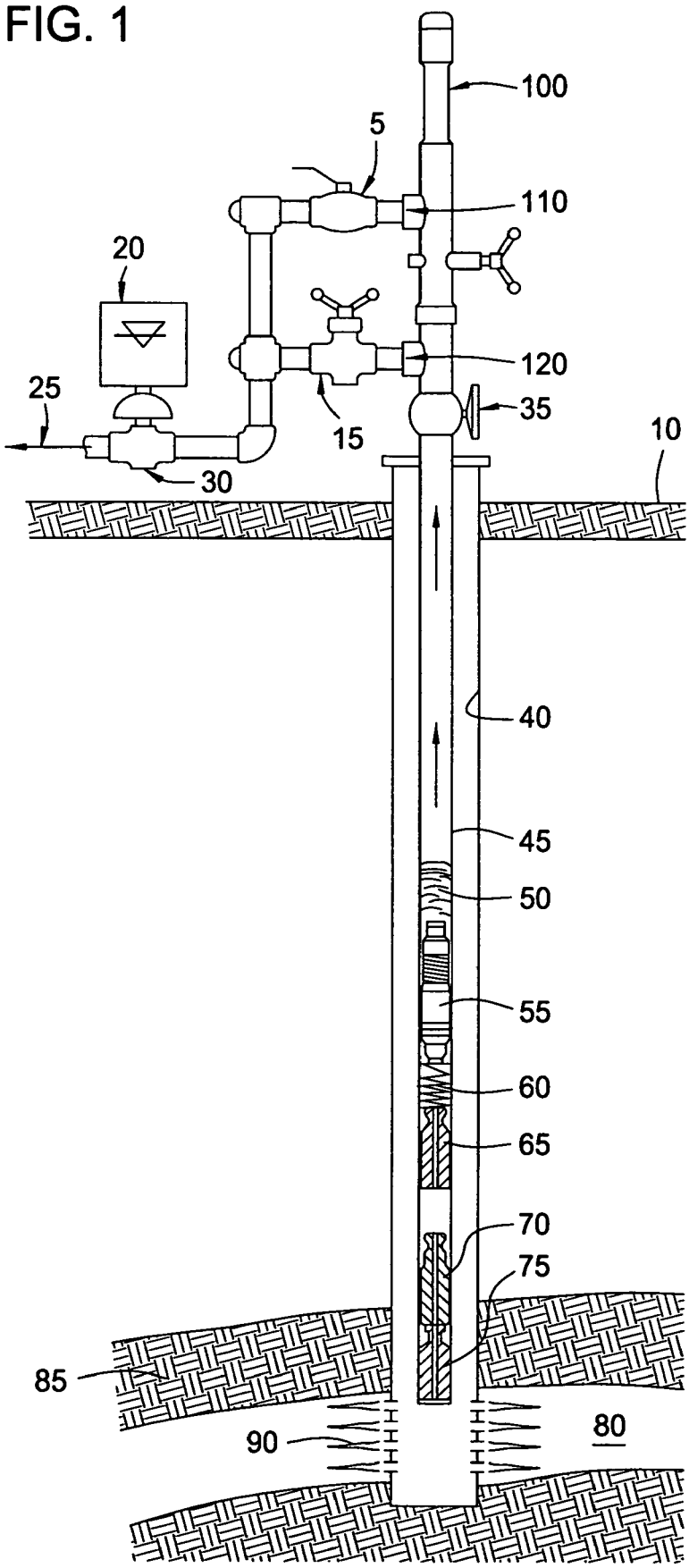
FIG. 1 is a sectional view of a plunger lift system.
Figure 2:
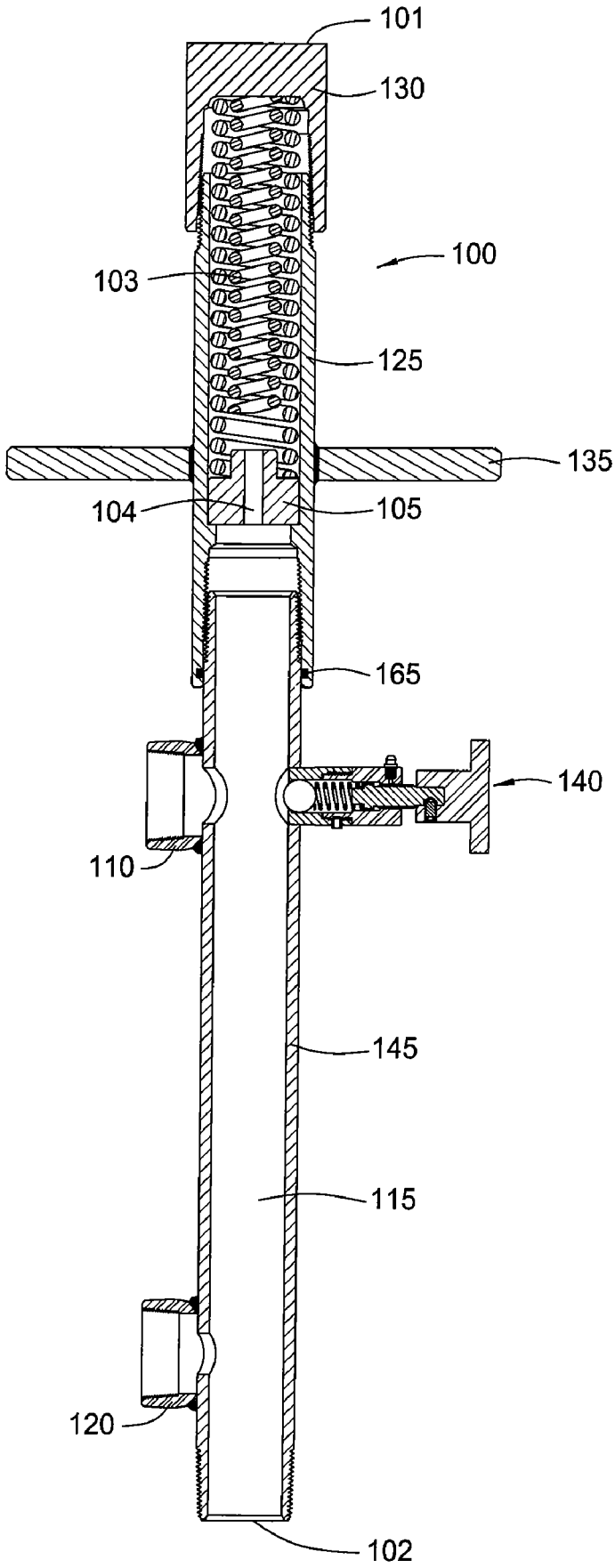
FIG. 2 (PRIOR ART)
FIG. 2 is a section view of a lubricator usable with the plunger lift system of FIG. 1.
Figure 3:
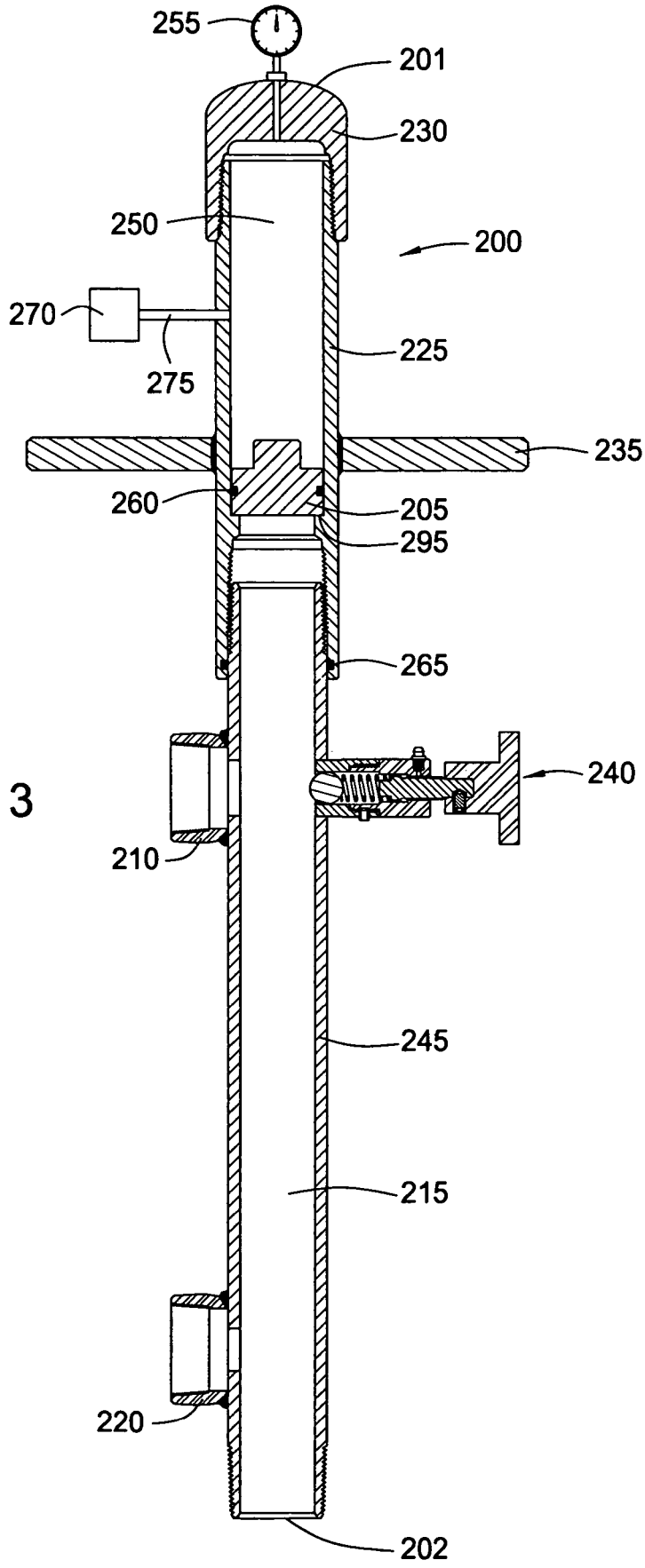
FIG. 3 is a section view of a lubricator consistent with embodiments of the present invention. The lubricator is in a position for cushioning a plunger.
Figure 4:
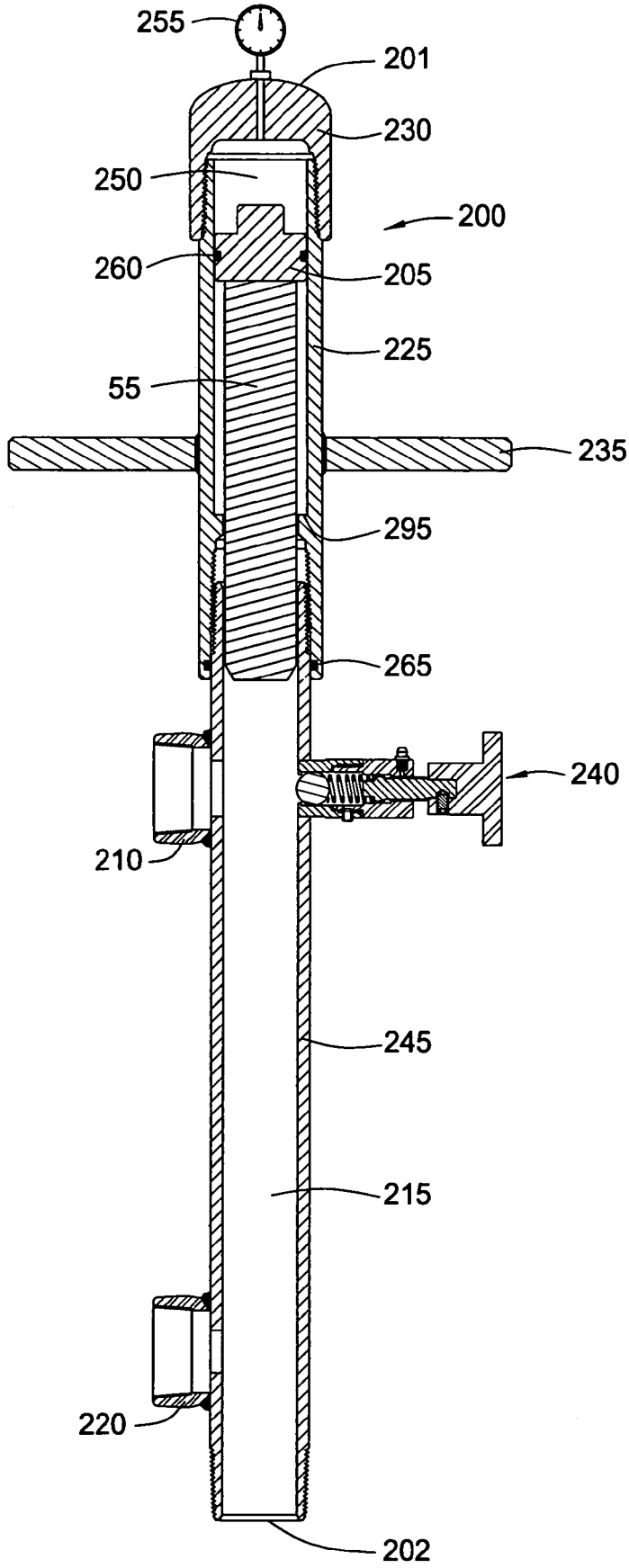
FIG. 4 is a section view of the lubricator of FIG. 3, with the lubricator receiving and cushioning the plunger with pressurized gas-phase fluid.

FIGS. 3 and 4 show a lubricator 200 instead of the lubricator 100 in the plunger lift system of FIG. 1. Rather than using the spring 103, as shown in FIG. 2, embodiments of the present invention illustrated in FIGS. 3 and 4 include a chamber 250 having compressible gas therein. One or more liquids such as silicone or some other lubricant may optionally be disposed within the chamber 250 to lubricate the chamber 250 or to provide an intermediate.

The lubricator 200 has an upper end 201 and a lower end 202. The lower end 202 is operatively attached to the downhole portion of the plunger lift system of FIG. 1, including the production tubing 45, and is preferably operatively attached to an upper end of the master valve 35.

Between the upper and lower ends 201, 202 is a generally tubular-shaped body. The tubular body may include one continuous tubular or may include a tubular string having two or more tubular sections threadedly connected to one another. As shown in the embodiment of FIGS. 3 and 4, the tubular body includes a first tubular section 225 operatively connected (preferably threadedly connected) to a second tubular section 245. A generally longitudinal bore 215 extends through the tubular body from its upper end to its lower end 202.

The connection between the two tubular sections 225, 245 is at least substantially sealed to at least substantially prevent fluid communication between the bore 215 and the outside of the tubular body using one or more sealing elements 265. The sealing elements 265 are preferably o-ring seals.

The upper end of the tubular body is closable from the surrounding atmosphere. To this end, operatively connected to the upper end of the tubular body, preferably by a threaded connection, is a cap 230. The cap 230 separates the atmosphere surrounding the lubricator 200 from the bore 215 of the lubricator 200 and acts as a final stop mechanism for the plunger 55 (see FIG. 1 for plunger 55). Additionally, the cap 230 provides a portion of the boundary for the chamber 250. Although the cap 230 may be of any shape where it is still capable of performing its functions, the cap 230 is preferably rounded, as shown in FIGS. 3-4. The cap 230 may be removable from the remainder of the lubricator 200.

One or more handles 235 extend from an outer diameter of the tubular body. Substantially the same as the handles 135 shown and described in relation to FIG. 1, the handles 235 may be utilized to physically manipulate the lubricator 200, e.g., lift and/or lower the lubricator 200.

Also extending from a portion of the tubular body are a first fluid flow outlet 210 and a second fluid flow outlet 220, which are substantially the same as the first and second fluid flow outlets 110, 120 described above. The first and second fluid flow outlets 210, 220 have bores which extend into and selectively communicate with the bore 215 of the tubular body. The liquid load 50 of production fluid (including hydrocarbon fluid and/or water) is expended from the lubricator 200 through one or both of the fluid flow outlets 210, 220 to form the product 25. When it is desired to only utilize one fluid flow outlet for expending the liquid load 50 from the lubricator 200, one of the fluid flow outlets 210, 220 may be selectively blocked through operation of one or more valves within the bore of the outlet 210, 220.

Although a dual flow outlet lubricator 200 including two separate fluid flow outlets 210, 220 is depicted in the embodiment shown in FIGS. 3-4, it is within the purview of alternate embodiments of the present invention that the lubricator 200 may instead only include one fluid flow outlet on its tubular body. When only a single flow outlet exists, a flow tee may be utilized to change an existing single flow outlet into a dual flow outlet.

A catcher assembly 240 also extends from a portion of the tubular body and has access to the bore 215 of the lubricator 200. The catcher assembly 240 is designed to catch the plunger 55 upon its arrival in a portion of the bore 215 proximate the catcher assembly 240, if desired, and may include any catcher assembly for a lubricator known or used by those skilled in the art. Catching the plunger 55 using the catcher assembly 240 allows the operator to retrieve the plunger 55 during the plunger lift operation for inspection, removal, repair, and/or replacement. The catcher assembly 240 may also be used to at least temporarily halt the operation of the plunger lift system by ceasing movement of the plunger 55. The cap 230 may be removed (unthreaded) from the tubular body to allow access to the plunger 55 for its removal from the lubricator 200 or for its inspection. To accomplish removal of the plunger 55 from the bore 215, a striker assembly 205 (described below) may be removed from the bore 215 prior to removal of the plunger 55.

The pressurized and at least substantially sealed chamber 250 is shown in FIGS. 3-4. The chamber 250 is bounded by an inside surface of the cap 230, an inner diameter of the first tubular section 225, and an upper surface of the striker assembly 205. One or more sealing elements (not shown) may be provided at the connection between the first tubular section 225 and the cap 230 to maintain a pressure seal within the chamber 250.

The striker assembly 205 provides a moveable, circumferential solid surface which simultaneously maintains a sealed interface between the outer diameter of the solid surface and the inner diameter of the first tubular section 225. The striker assembly 205 is movable in response to pressure applied to the upper or lower surface of the striker assembly 205.

Along with being circumferentially shaped to substantially match the shape of the bore 215, the striker assembly 205 is preferably of a first diameter at its lower surface, which faces the lower portion of the bore 215 below the striker assembly 205, and then of the first diameter for a given length. The striker assembly 205 then preferably is reduced to a smaller, second diameter and extends for a given length at this diameter to an upper surface facing the chamber 250. Unlike the striker assembly 105 shown and described in relation to FIG. 2, it is preferable that no opening 104 through the striker assembly 205 exists so that the chamber 250 is sealed and isolated from the remainder of the bore 215 and from the atmosphere outside the lubricator 200. Also, to maintain the sealed nature of the chamber 250, one or more sealing elements 260 are provided at the interface between the striker assembly 205 and the first tubular section 225.

Essentially, the chamber 250 has a top boundary of the cap 230, side boundaries of the portion of the first tubular section 225 located above the striker assembly 205, and a lower boundary of the surfaces of the-striker assembly 205 facing the chamber 250. Because the striker assembly 205 is slidable relative to the first tubular section 225, the size (length, as defined between the inner surface of the cap 230 and the upper surfaces of the striker assembly 205) and the available volume within the chamber 250 are variable according to the position of the striker assembly 205 within the first tubular section 225. However, the maximum size and volume of the chamber 250 are defined by a stop shoulder 295 of the first tubular section 225, which provides an inner diameter restriction within the bore 215 of lubricator 200 upon which the lower surface of the striker assembly 205 rests at its lowermost point within the bore 215.

The distance of the stop shoulder 295 from the lower surface of the cap 230 is adjustable to optimize cushioning ability of the chamber 250 by adjusting the size and available volume within the chamber 250. Additionally, the length of the portion of the tubular body extending below the stop shoulder 295 is adjustable to provide the optimum travel distance for the plunger 55 prior to the plunger 55 impacting the striker assembly 205 (described below). Preferably, the portion of the tubular body extending below the stop shoulder 295 is extended, as compared to a traditional lubricator 200, in embodiments of the present invention.

One or more compressible gases are disposed within the chamber 250. Moving the striker assembly 205 upward within the bore 215 decreases the volume of the chamber 250. Decreasing the volume of the chamber 250 increases compression of the pressurized gas (because the chamber 250 is sealed and the maximum distance of travel of the striker assembly 205 is defined by the stop shoulder 295 location, and the gas therefore cannot escape the chamber 250 to occupy a larger volume), which proportionally increases the amount of pressure within the chamber 250. As a result, an increase in pressure (or force applied on the upper surface of the striker assembly 205) is related to the amount of travel that the striker assembly 205 undergoes due to the plunger 55 impacting the striker assembly 205 (as described below).

The compressible gas may include, but is not limited to, the following: nitrogen, carbon dioxide, the well's natural gas, or any combination thereof. A device capable of pressurizing the chamber 250 by increasing or decreasing the amount of gas within the chamber 250, preferably a compressor tank 270, is operatively connected to tubing 275 or piping which communicates with the chamber 250. In the alternative, the pressurizing device may be a gas lift valve assembly or a similar assembly. The tubing 275 and compressor tank 270 are in an at least substantially sealed relationship with the chamber 250, and the gas is capable of flowing into and out of the chamber 250 through the tubing 275.

In one embodiment, the compressor tank 270 and tubing 275 are connected to the first tubular section 225 intermittently, as desired or needed to regulate the amount of gas (and thus the amount of pressure in a set volume) within the chamber 250. In an alternate embodiment, the compressor tank 270 is permanently connected to the first tubular section 225.

A pressure gauging mechanism, preferably a pressure gauge 255, is operatively connected to the lubricator 200 (in the embodiment shown in FIGS. 3-4, the gauge 255 reaches the chamber 250 through the cap 230). The pressure gauge 255 provides an indication to an operator of the amount of pressure existing within the chamber 250 in real time. Because of the pressure gauge 255, dynamic conditions within the lubricator 200 are attainable without taking the lubricator 200 apart, as must be done with the lubricator 100 shown in FIG. 2 to determine and change the dynamic conditions of the spring 103. Accordingly, the cushioning ability (shock or energy-absorption ability) of the lubricator 200 is dynamically determinable without interrupting the operation of the plunger lift system using the embodiment shown in FIGS. 3-4.

The pressure gauge 255 may include a digital input capable of shutting in the lubricator 200 upon failure of the sealing elements 260, as indicated by a given decrease in pressure within the chamber 250 shown on the pressure gauge 255. Additionally, a computer monitoring and control unit (not shown) may optionally be operatively connected to the pressure gauge 255 and the compressor tank 270 to receive readings of the pressure within the chamber 250 from the pressure gauge 255 and communicate to the compressor tank 270 an amount of gas which should be removed or added to the chamber 250 to maintain the desired pressure within the chamber 250 for cushioning the impact of the plunger 55. The computer monitoring and control unit may also, by communication with the pressure gauge 255, dictate the position of the striker assembly 205 needed to obtain the desired pressure within the chamber 250. Thus, the plunger energy-absorbing ability of the lubricator 200 may be monitored and altered in real time during operation of the plunger lift system.

FIGS. 3 and 4 illustrate a method of operation of the lubricator 200. In operation, the lubricator 200 is operatively connected to the tubular 45 (e.g., by connection to the master valve 35) to allow the plunger 55 to travel between the bore of the tubular 45 and the bore 215 of the lubricator 200. To prepare the chamber 350, the pressurizing assembly 270 may be operated to insert compressible gas into the chamber 250 or to remove compressible gas from the chamber 250. The pressure gauge 255 indicates the pressure within the chamber 250 during the removal or insertion of the compressible gas. The amount of compressible gas within the chamber 250 (and the pressure within the chamber 250 produced therefrom) is preferably an amount at which the kinetic energy of the plunger 55 is sufficiently slowed and stopped so as to prevent or at least minimize damage to any component of the plunger lift system. The computer monitoring and control unit may be used to determine the optimal amount of compressible gas to input or remove from the chamber 250 to obtain the pressure desired within the chamber 250.

At the maximum point of extension of the striker assembly 205 from the upper end 201 (due to the presence of the stop shoulder 295), the chamber 250 is of a fixed volume, so that adding compressible gas to the chamber 250 increases the pressure within the chamber 250, while removing gas from the chamber 250 decreases the pressure within the chamber 250. The lubricator 200 is preferably designed so that the maximum point of extension of the striker assembly 205 from the upper end 201 accompanied with an optimal pressure within the chamber 250 produces the desired cushioning effect for preventing damage to the plunger lift system components. FIG. 3 shows the striker assembly 205 at its point of maximum extension from the upper end 201.

Ultimately, the design of the lubricator 200 should take into account the maximum amount of pressure which could be placed on the striker assembly 205 and the maximum velocity or momentum that the plunger 55 could reach during the operation of the plunger lift system. The maximum amount of force and pressure that the plunger 55 could apply to the striker assembly 205 is then related to the amount of gas pressure above the striker assembly 205 which is necessary to effectively cushion the impact of the plunger 55.

The plunger 55 is utilized to obtain production fluid (including hydrocarbon fluid and/or water) from the reservoir 80, as shown in FIG. 1. Near or at the end or its down-stroke, the plunger 55 picks up the fluid load 50 removed from the reservoir 80. At its lowermost point of travel, the plunger 55 contacts the bumper spring 60 (or any other kinetic energy-reducing mechanism known or used by those skilled in the art). The bumper spring 60 decreases the kinetic energy of the plunger 55, stops the movement of the plunger 55, and reverses the direction of the plunger 55 so that the plunger 55 travels upward within the bore of the tubular 45, as shown in FIG. 1.

The plunger 55 then travels up through the bore of the master valve 35 and into the bore 215 of the lubricator 200. At any point in time of the plunger's 55 travel through the plunger lift system, the pressure within the chamber 250 may be altered by changing the amount of compressible gas within the chamber 250 and/or by changing the position of the striker assembly 205 within the bore 215.

When the liquid load 50 reaches the second fluid flow outlet 220 (now referring to FIG. 3), at least a portion of the liquid load 50 flows out from the bore 215 through the second fluid flow outlet 220. Likewise, when any remaining portion of the liquid load 50 reaches the first fluid flow outlet 210, the remaining portion of the liquid load 50 flows out from the bore 215 through the first fluid flow outlet 210. In an alternate embodiment, one of the first fluid flow outlet 210 or the second fluid flow outlet 220 is closed so that all of the liquid load 50 exits through the fluid flow outlet 210 or 220 which remains open. The liquid load 50 ultimately flows out of the system as flow stream 25 (shown in FIG. 1).

At this step in the operation of the plunger lift system, the catcher assembly 240 may optionally be operated to catch the plunger 55 and temporarily or permanently stop the operation of the plunger lift system, e.g., to allow inspection of the plunger 55 for damage or removal of the plunger 55. The cap 230 may be removed (e.g., unthreaded from the first tubular section 225) to remove the plunger 55 from the lubricator 200 in this situation without the plunger 55 blowing out from the lubricator 200 upon removal of the cap 230.

In the absence of operation of the catcher assembly 240, the plunger 55 continues its travel upward through the bore 215 of the lubricator 200. The plunger 55 essentially acts as a piston within a cylinder (the cylinder being the first tubular section 225), so that eventually a pressure between the plunger 55 and the striker assembly 205 builds up within the bore 215.

Upon a given pressure differential between the pressure within the chamber 250 and the pressure below the striker assembly 205, where the pressure below the striker assembly 205 is higher than the pressure within the chamber 250, the striker assembly 205 begins its upward movement relative to the first tubular section 225 so that the volume within the chamber 250 decreases upon upward movement of the striker assembly 205. The decrease in volume within the chamber 250 compresses the gas within the chamber 250. Compressing the gas within the chamber 250 proportionally increases the pressure of the gas within the chamber 250. This proportional increase of pressure within the chamber 250 produces a gradual increase in the downward, opposing force exerted on the plunger 55 relative to the upward force of the moving plunger 55, thereby cushioning the impact of the plunger 55 on any solid surface of the lubricator 200. Cushioning the impact of the plunger 55 on any solid surface of the lubricator 200 by gradually decreasing the kinetic energy of the plunger 55 decreases the damage to the plunger 55 or any of the components (solid surfaces) of the lubricator 200.

Upon the pressure within the chamber 250 reaching a given value, the striker assembly 205 can no longer move upward relative to the first tubular section 225 because a sufficient pressure differential (between the chamber 250 and the bore 215 portion below the striker assembly 205) capable of moving the striker assembly 205 upward no longer exists. When the striker assembly 205 loses its ability to move upward within the first tubular section 225, the plunger 55 is stopped from its upward movement, thus ending its up-stroke, and its downward movement through the bore 215 begins (its down-stroke). Before the FIG. 4 shows the plunger 55 at the end of its up-stroke.

In FIG. 4, the upper end of the plunger 55 is touching the lower surface of the striker assembly 205. While this is within the scope of embodiments of the present invention, it is preferable for the plunger 55 to never actually touch the striker assembly 205 because of the pocket of pressurized gas existing between the piston-like plunger 55 and the striker assembly 205. In this preferable embodiment, no solid metal contacts result during operation of the lubricator 200, as the maximum amount of force that can be applied to the plunger 55 will be considered and this amount will be placed back on the plunger 55 before a solid metal contact can be reached (such as the solid metal contact between the plunger 55 and the striker assembly 205).

Preferably, a portion of the compressed gas is allowed to flow out of the chamber 250 to equalize pressure above and below the striker assembly 205 before the plunger 55 begins its down-stroke. Equalizing the pressure between the chamber 250 and the remainder of the bore 215 increases the safety of the lubricator 200 by reducing chances of blow-out.

The plunger 55 then travels down through the tubular 45 to eventually obtain another fluid load from the reservoir 80, impact the lower bumper spring 60, and again begin its upward travel through the tubular 45. The cycle of the up-stroke and the down-stroke may be repeated as necessary or desired. The striker assembly 205 is capable of resetting itself to its original position (its position before the impact of the plunger 55) before another impact of the plunger 55 at or near the end of its next up-stroke.

By using the lubricator 200 of the present invention, the piston-type motion results in the pressure of the traveling plunger 55 within the bore 215 being exerted on the striking pad 205 rather than on the spring 103 of the spring-based lubricator 100.

The above-described embodiments of the present invention provide several advantages over spring-based lubricators. First, the force exerted by the lubricator 200 on the plunger 55 is dynamically changeable without requiring the physical removal or insertion of parts (e.g., the spring 103) of the lubricator 200. Specifically, in the spring-based lubricator 100, the opposing force of the previously-used spring 103 (shown in FIG. 2) remains the same unless the spring 103 is removed from the lubricator 100 and is replaced with a different spring having a stronger or weaker biasing force capability. In contrast, in the embodiments of the present invention shown in FIGS. 3 and 4, the cushioning ability of the lubricator 200 (the opposing force the lubricator 200 exerts on the plunger 55 to decrease its kinetic energy) is dynamically manipulatable over time according to conditions by simply adding or reducing amount of compressible gas within the chamber 250 and/or by changing the position of the striker assembly 205 relative to the first tubular section 225. As opposed to the spring-based lubricator 100, the operation of the plunger lift system of embodiments of the present invention does not have to be halted to change the magnitude of opposing force exerted on the plunger 55 at or near the end of its up-stroke.

An additional advantage obtained with embodiments of the present invention is the gradual stopping of the plunger 55 motion at or near the end of its up-stroke. The plunger-cushioning effect is much more desirable in the gradual, controlled, adjustable stoppage of the plunger 55 using the compressed gas within the chamber 250 than in the more abrupt stoppage of the spring-based lubricator 100 using the rigid spring 103.

Moreover, embodiments of the lubricator of the present invention are advantageous over spring-based systems and methods because problems within the lubricator 200, especially problems with the portion of the lubricator 200 providing the cushioning effect, may be easily detected by the pressure gauge 255. Previously, in the spring-based lubricator 100, problems with the spring 103 and other internal components were undetectable from the outside of the lubricator 100 because the cushioning components within the lubricator 100 (e.g., spring 103, striker assembly 105) as well as the plunger 55 were not visible from the outside of the lubricator 100. Therefore, to inspect components within the spring-based lubricator 100, the plunger lift operation must be shut down to inspect the components therein for damage. Additionally, a time of damage is not readily recognizable during the operation of the spring-based lubricator 100, so that blowouts may occur because of insufficient frequency of inspection. The inability to readily detect problems within the lubricator 100 results in breakage or damage to the plunger 55 and/or lubricator 100. In contrast, with embodiments of the present invention, failure or ineffective operation of components within the plunger lift system (e.g., failure of the seals 260) is easily detectable by the pressure gauge 255 and the control unit. If warranted, the plunger lift system may then be shut down to prevent a blowout due to plunger 55 and/or lubricator 200 breakage or damage.

Therefore, embodiments of the lubricator of the present invention provide at least the resilience of the spring within the lubricator, but at the same time are not as easily damaged, and damage is more easily detected than with the lubricator including the spring.

Although embodiments described above are explained in terms of "upper," "lower," "up-stroke," "down-stroke," and similar directional terms, these terms are used only for illustration purposes. As such, the lubricator, its components, and its methods or operation are not limited to the vertical orientation, but components (and their movements) may be horizontally oriented or positioned in any angled orientation between vertical and horizontal. Additionally, embodiments of the lubricator of the present invention and its components and methods of operation are not limited to components positioned or to components moving in the upper and lower directions; rather, these directional terms are merely used herein to indicate positions of components and movement of components relative to one another (e.g., left and right of one another).

While the foregoing is directed to embodiments of the present invention, other and further embodiments of the invention may be devised without departing from the basic scope thereof, and the scope thereof is determined by the claims that follow.

The invention claimed is:

1. A lubricator for reducing a kinetic energy of a plunger at a surface of a wellbore in a plunger lift system, comprising:

a generally tubular body having a bore therethrough, the bore closed at an end portion thereof;

a striker assembly within the bore having a sealed relationship with the tubular body and movable with respect to the tubular body; and a pressurized, sealed chamber formed within the bore between the closed portion and the striker assembly to reduce the kinetic energy of the plunger at the surface, wherein the chamber is initially pressurized prior to movement of the striker assembly with respect to the tubular body.

2. The lubricator of claim 1, wherein the striker assembly at least substantially prevents fluid communication between the chamber and a remainder of the bore.

3. The lubricator of claim 1, wherein the chamber is pressurized by a compressed gas disposed therein.

4. The lubricator of claim 3, wherein the compressed gas comprises nitrogen.

5. The lubricator of claim 3, wherein the compressed gas comprises carbon dioxide.

6. The lubricator of claim 3, wherein the compressed gas comprises natural gas from within the wellbore.

7. The lubricator of claim 1, wherein the closed portion is a rounded cap.

8. A method of decreasing a kinetic energy of a plunger moving through a lubricator, comprising:

providing a lubricator having a sealed, pressurized chamber within a portion of its bore, the chamber partially enclosed by a striker assembly, wherein the chamber is initially pressurized prior to movement of the striker assembly;

moving the plunger through the bore of the lubricator;

contacting the striker assembly with pressure induced by the plunger; and decreasing the kinetic energy of the plunger by moving the striker assembly through the sealed chamber.

9. The method of claim 8, wherein moving the striker assembly through the sealed chamber increases pressure within the chamber.

10. The method of claim 8, wherein compressed gas is disposed within chamber.

11. The method of claim 10, wherein moving the striker assembly through the sealed chamber compresses the gas within the chamber.

12. The method of claim 8, wherein pressure within the chamber is initially greater than pressure within a remainder of the bore.

13. The method of claim 8, further comprising monitoring a pressure within the chamber.

14. The method of claim 8, wherein moving the striker assembly through the sealed chamber occurs when pressure induced by the plunger is a predetermined amount greater than pressure within the chamber.

15. A lubricator for reducing shock of a plunger within a plunger lift system upon impact with a kinetic energy-decreasing surface within the lubricator, comprising:

a substantially tubular body having a pressurized, sealed chamber at least partially bounded by the surface, wherein the surface is movable to alter the pressure within the chamber while maintaining the seal of the chamber, wherein the chamber is initially pressurized prior to movement of the surface.

16. The lubricator of claim 15, wherein the surface is movable when pressure within a remainder of the lubricator exceeds pressure within the chamber by a predetermined value.

17. A lubricator for reducing a kinetic energy of a plunger at a surface of a wellbore in a plunger lift system, comprising:

a generally tubular body having a bore therethrough, the bore closed at an end portion thereof;

a striker assembly within the bore having a sealed relationship with the tubular body and movable with respect to the tubular body;

a pressurized, sealed chamber formed within the bore between the closed portion and the striker assembly to reduce the kinetic energy of the plunger at the surface; and a pressure gauging mechanism for determining a pressure within the chamber, wherein the pressure gauging mechanism comprises a digital input for regulating pressure within the chamber.

18. A lubricator for reducing a kinetic energy of a plunger at a surface of a wellbore in a plunger lift system, comprising:

a generally tubular body having a bore therethrough, the bore closed at an end portion thereof;

a striker assembly within the bore having a sealed relationship with the tubular body and movable with respect to the tubular body;

a pressurized, sealed chamber formed within the bore between the closed portion and the striker assembly to reduce the kinetic energy of the plunger at the surface; and a pressure gauging mechanism for determining a pressure within the chamber, wherein the pressure gauging mechanism is capable of closing off the lubricator from a surrounding atmosphere upon a decrease in pressure of a predetermined value.

19. A lubricator for reducing a kinetic energy of a plunger at a surface of a wellbore in a plunger lift system, comprising:

a generally tubular body having a bore therethrough, the bore closed at an end portion thereof;

a striker assembly within the bore having a sealed relationship with the tubular body and movable with respect to the tubular body;

a pressurized, sealed chamber formed within the bore between the closed portion and the striker assembly to reduce the kinetic energy of the plunger at the surface, wherein the chamber is operatively connected to a compressor tank capable of further pressurizing a compressed gas within the chamber; and a monitoring and control unit in communication with the compressor tank and the chamber to allow or prevent further pressurizing of the chamber.

20. A method of decreasing a kinetic energy of a plunger moving through a lubricator, comprising:

providing a lubricator having a sealed, pressurized chamber within a portion of its bore, the chamber partially enclosed by a striker assembly;

moving the plunger through the bore of the lubricator;

contacting the striker assembly with pressure induced by the plunger;

decreasing the kinetic energy of the plunger by moving the striker assembly through the sealed chamber; and producing a pressure within the chamber capable of optimally reducing the kinetic energy of the plunger.

21. The method of claim 20, wherein producing the pressure within the chamber is accomplished by compressing a gas within the chamber.

* * * * *